US010421600B2

(12) United States Patent
Sheehan

(10) Patent No.: US 10,421,600 B2
(45) Date of Patent: Sep. 24, 2019

(54) DECONSTRUCTABLE COILED TUBING SPOOL AND METHOD OF SHIPPING SAME

(71) Applicant: FORUM US, INC., Houston, TX (US)

(72) Inventor: Alex Paul Sheehan, Houston, TX (US)

(73) Assignee: FORUM US, INC., Houston, TX (US)

( * ) Notice: Subject to any disclaimer, the term of this patent is extended or adjusted under 35 U.S.C. 154(b) by 7 days.

(21) Appl. No.: 15/452,943

(22) Filed: Mar. 8, 2017

(65) Prior Publication Data

US 2017/0291756 A1 Oct. 12, 2017

Related U.S. Application Data

(60) Provisional application No. 62/360,806, filed on Jul. 11, 2016, provisional application No. 62/319,891, filed on Apr. 8, 2016.

(51) Int. Cl.

| | |
|---|---|
| ***B65D 85/04*** | (2006.01) |
| ***B65H 75/22*** | (2006.01) |
| ***E21B 19/22*** | (2006.01) |
| *B65H 75/14* | (2006.01) |

(52) U.S. Cl.

CPC ..... *B65D 85/04* (2013.01); *B65H 75/22* (2013.01); *E21B 19/22* (2013.01); *B65H 75/14* (2013.01); *B65H 2701/33* (2013.01)

(58) Field of Classification Search

CPC ..... B65H 75/22; B65H 75/18; B65H 75/14; B65H 49/38; B65D 85/04

See application file for complete search history.

(56) References Cited

U.S. PATENT DOCUMENTS

| | | | | |
|---|---|---|---|---|
| 1,905,488 | A * | 4/1933 | Nack | B65H 75/141 206/399 |
| 3,207,456 | A * | 9/1965 | Hill | B65H 49/32 242/118.5 |
| 4,895,316 | A * | 1/1990 | Salloum | B65H 75/14 242/118.4 |
| 5,137,152 | A * | 8/1992 | Ogose | B65D 85/66 206/389 |
| 5,242,129 | A * | 9/1993 | Bailey | B65H 75/22 242/607 |
| 6,352,216 | B1 * | 3/2002 | Coats | B65H 75/22 242/608.4 |
| 6,598,825 | B2 * | 7/2003 | Ripplinger | B65H 75/14 242/608.3 |
| 2008/0245920 | A1 * | 10/2008 | Houen | B65H 75/22 242/407.1 |

FOREIGN PATENT DOCUMENTS

FR 2898351 A1 9/2007

OTHER PUBLICATIONS

Construct AS, M-Reel Brochure, Accessed Online: http://www.construct.as/ on Jun. 2, 2017.

International Search Report and Written Opinion for Application No. PCT/US2017/021356 dated Jun. 1, 2017.

* cited by examiner

*Primary Examiner* — Mollie Impink

(74) *Attorney, Agent, or Firm* — Patterson + Sheridan, LLP

(57) ABSTRACT

A deconstructable coiled tubing spool is disclosed and includes one or more flange segments, and a core comprising a flange portion that is adapted to couple and decouple from each of the one or more flange segments, wherein the core remains intact when the one or more flange segments are decoupled from the flange portion. One or more of the (Continued)

deconstructable coiled tubing spools can be deconstructed and stored in a standard shipping container for shipment.

11 Claims, 5 Drawing Sheets

DECONSTRUCTABLE COILED TUBING SPOOL AND METHOD OF SHIPPING SAME

CROSS-REFERENCE TO RELATED APPLICATION

This application claims benefit of U.S. Provisional Patent Application Ser. No. 62/360,806, filed on Jul. 11, 2016, and U.S. Provisional Patent Application Ser. No. 62/319,891, filed on Apr. 8, 2016, which are both herein incorporated by reference in their entirety.

BACKGROUND

Field

Embodiments of the disclosure generally relate to a spool for coiled tubing, more specifically, to a spool that may be deconstructed for shipping after the coiled tubing is removed.

Description of the Related Art

In the oil and gas industry, coned tubing, which is generally a very long metal pipe, is supplied and shipped around the world on a large spool consisting of a core surrounded by a flange on both sides of the core. The coned tubing, normally about 1 inch in diameter to about 3.25 inch in diameter, may be used for interventions in oil and gas wells, pipelines, and sometimes as production tubing.

When the coiled tubing is removed from the spool, the empty spool is usually scrapped because shipping the empty spool back to the supplier for reuse is cost prohibitive. Most conventional spools are heavy and large, having a height between about 100 inches and about 204 inches based on the flange diameter. When supplied overseas, the size of the empty spools requires shipment on a deck of a ship, in which individual spools are loaded and unloaded using a crane, and the spools take up a large footprint on the deck of the ship, all of which increases the shipping cost of the empty spools.

Therefore, there exists a need for a spool that can be reused and shipped more efficiently.

SUMMARY

In one embodiment, a deconstructable coiled tubing spool is disclosed and includes a core having a curved outer surface; and a plurality of flange segments each having a first structural member coupled to the curved outer surface of the core, wherein the core remains intact when the flange segments are decoupled from the core.

In one embodiment, a deconstructable coiled tubing spool is disclosed and includes one or more flange segments, and a core comprising a flange portion that is adapted to couple and decouple from each of the one or more flange segments, wherein the core remains intact when the one or more flange segments are decoupled from the flange portion.

In one embodiment, a standard intermodal shipping container is disclosed and includes an interior volume containing one, two, three, four, five, six, seven, or more deconstructable coiled tubing spools, each of the spools comprising an intact core and at least four flange segments.

In one embodiment, a method for deconstructing a coiled tubing spool is disclosed and includes (a) detaching four flange segments from each side of a core by removing a plurality of fasteners disposed in a bolt interface at an intersection between a flange portion of the core and an end of each of the flange segments.

BRIEF DESCRIPTION OF THE DRAWINGS

Having generally described the various embodiments of the disclosure, reference will now be made to the accompanying drawings.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1A:
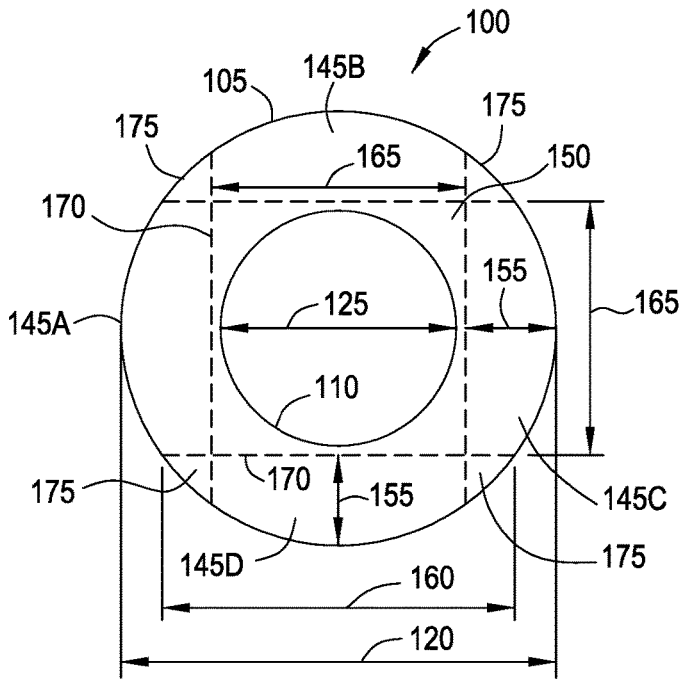
FIG. 1A is a side elevation view of one embodiment of a deconstructable spool.
Figure 1B:
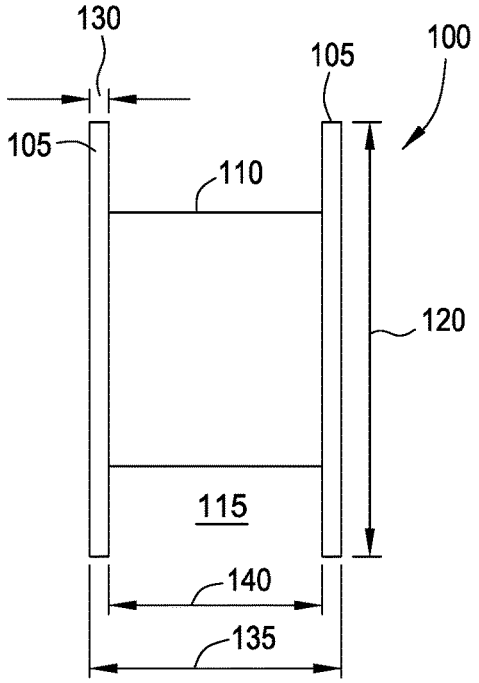
FIG. 1B is a front elevation view of the deconstructable spool of FIG. 1A.

FIGS. 1A and 1B are schematic views of a deconstructable spool 100 according to one embodiment. FIG. 1A is a side elevation view of the deconstructable spool 100 and FIG. 1B is a front elevation view of the deconstructable spool 100. In FIGS. 1A and 1B, the deconstructable spool 100 is shown intact but without any coiled tubing spooled onto the deconstructable spool 100.

The deconstructable spool 100 includes two flanges 105 that are coupled to opposite ends of a core 110. The core 110 may be a hollow tubular member having an opening into an interior volume on at least one side of the core 110. As shown in FIG. 1B, a space 115 between an outer surface of the core 110 and interior surfaces of the flanges 105 would generally be occupied with coiled tubing (not shown) that is spooled around the core 110, and subsequently reeled-off and used leaving the deconstructable spool 100 intact as shown.

The deconstructable spool 100 may include a major dimension 120 (a height or width, depending on the perspective, or a diameter of the flanges 105) of about 100 inches to about 204 inches. A diameter 125 of the core 110 may be between about 50 inches and about 80 inches. In some embodiments, the diameter 125 of the core 110 is constant while the diameter of the flanges 105 (the major dimension 120) may vary to accommodate different capacities of the deconstructable spool 100.

For example, the major dimension 120 may be changed to accommodate coiled tubing having a larger diameter and/or coiled tubing of different lengths without modifying the core 110. Other dimensions of the deconstructable spool 100 include a flange width 130 and a flange-to-flange outside dimension 135 as well as a flange-to-flange inside dimension 140. In one embodiment, the flange-to-flange inside dimension 140 is about 78 inches and the flange width 130 is about 5 inches which makes the flange-to-flange outside dimension 135 about 88 inches.

Figure 5A:
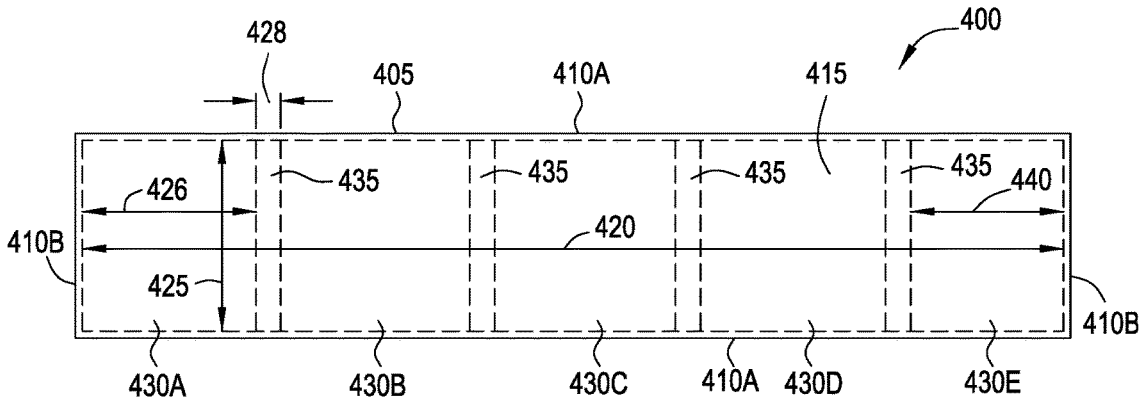
FIGS. 5A-5C are schematic cutaway top views of an exemplary standard intermodal shipping container showing various methods for shipping the deconstructable spool of FIGS. 1A and 1B or FIG. 2.
Figure 5B:
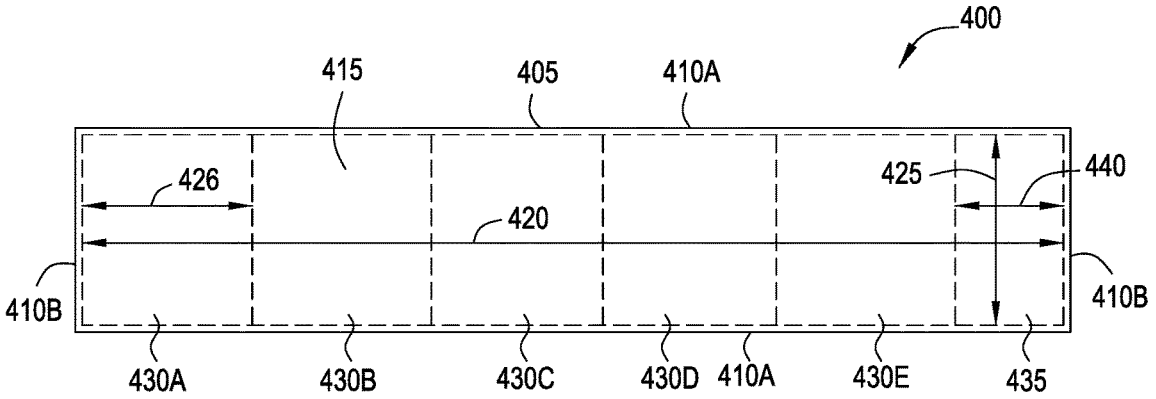
Figure 5C:
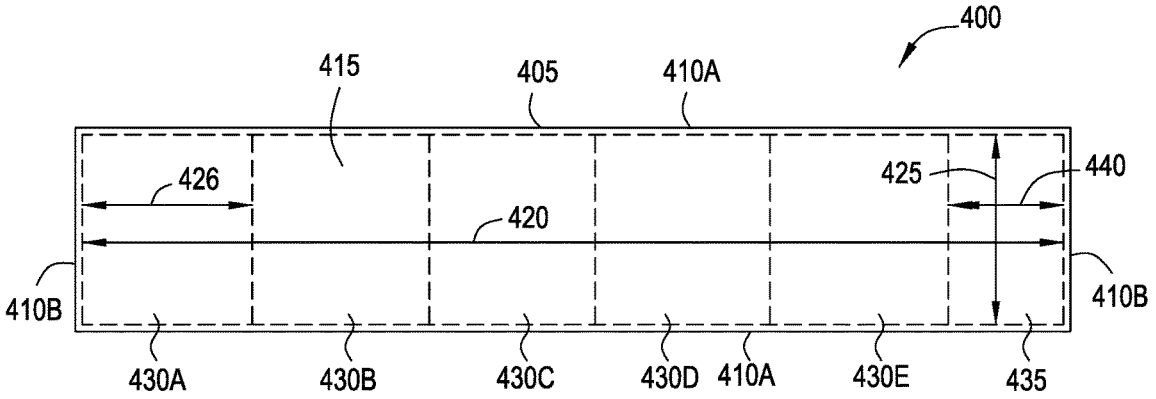

In one embodiment, the deconstructable spool 100 may be dismantled along the dashed lines shown in FIG. 1A to fit within a standard intermodal shipping container (shown in FIGS. 5A-5C). The deconstructable spool 100, once dismantled according to the embodiments described herein, may fit easily within the shipping container with the core 110 intact. Upon delivery of the dismantled deconstructable spool 100, the deconstructable spool 100 may be reconstructed for another use.

Referring to FIG. 1A, each of the flanges 105 (only one is shown in FIG. 1A but the other may be configured similarly) include four flange segments 145A-145D that are detachable and separable from a flange portion 150 of the core 110 using fasteners. Although four flange segments 145A-145D are shown, one or both of the flanges 105 may be formed out of two or more flange segments. The flange portions 150 of the core 110 may be coupled, such as by welding or fasteners, to the opposite ends of the hollow tubular member forming the core 110. In one embodiment, the flange portions 150 of the core 110 may be rectangular plates. The core 110 may remain intact when the flange segments 145A-145D are coupled to and decoupled from the flange portions 150 of the core 110.

Each of the flange segments 145A-145D, as well as the flange portion 150, include dimensions that easily fit within the volume of a shipping container when dismantled. For example, when the major dimension 120 is about 170 inches, the flange segments 145A-145D include a depth dimension 155 of about 43 inches, and a first length dimension 160 or a second length dimension 165. The first length dimension 160 may be about 140 inches and the second length dimension 165 may be about 84 inches, which is less than the first length dimension 160. The second length dimension 165 may be equal to the dimensions of sides 170 of the flange portion 150. In some embodiments, intersections of the dashed lines in the flange segments 145A-145D may form corner sections 175 that may not be included in some embodiments, thus making the second length dimension 165 substantially equal for all flange segments 145A-145D.

Figure 2:
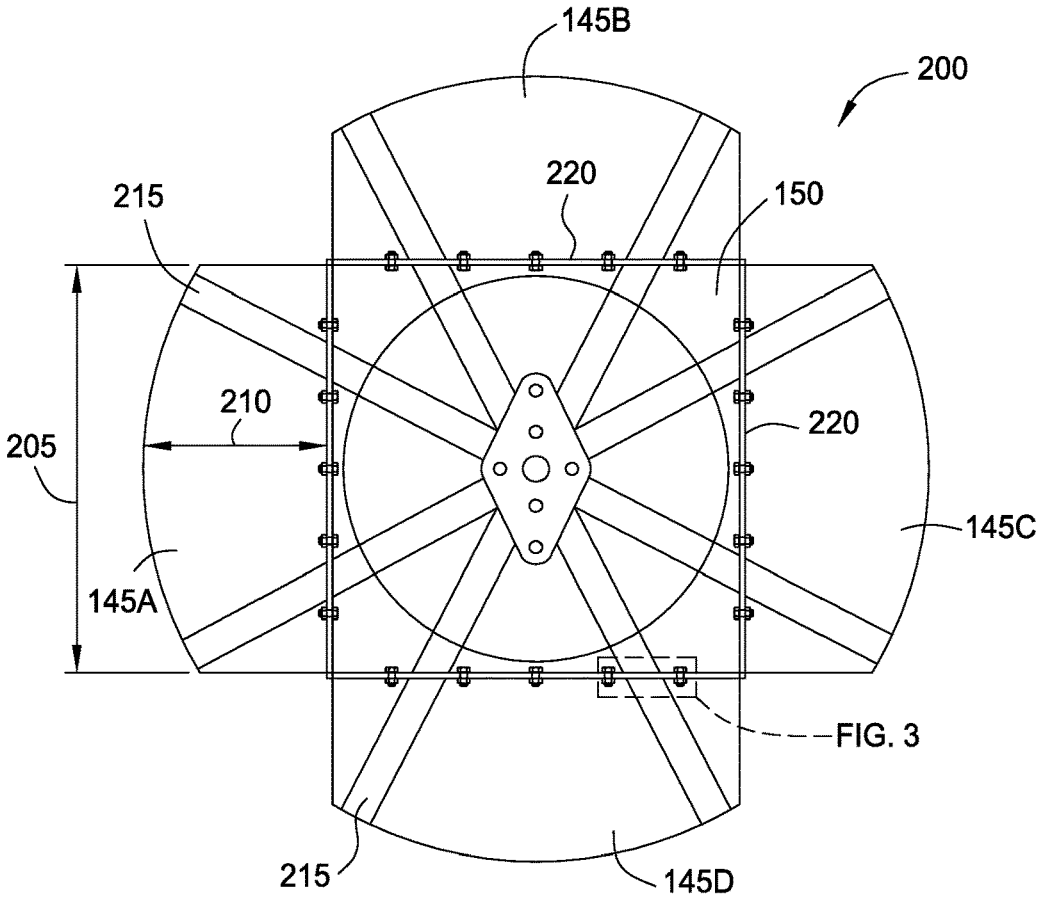
FIG. 2 is a schematic side view of one embodiment of a deconstructable spool.

FIG. 2 is a schematic side view of one embodiment of a deconstructable spool 200. In this embodiment, the flange segments 145A-145D do not include corner sections as shown in FIG. 1A. A first dimension 205 (e.g. a length dimension) of each of the flange segments 145A-145D may be substantially the same. Likewise, a second dimension 210 (e.g. a width dimension) of each of the flange segments 145A-145D may be substantially the same. The first dimension 205 may also be the same on each side of the flange portion 150. The second dimension 210 and the first dimension 205 are sized to allow the deconstructable spool 200 to fit within a standard intermodal shipping container.

The deconstructable spool 200 may also include support members 215 that extend across the flange portion 150 and to a periphery of the flange segments 145A-145D. The support members 215 may be tubing, channel iron, or other supports that provide structural rigidity to the deconstructable spool 200. A bolt interface 220 may be used to remove or attach the flange segments 145A-145D from or to the flange portion 150. The bolt interface 220 may be fixed to the flange portion 150, the flange segments 145A-145D, and/or the support members 215, such as by welding or fasteners.

Figure 4:
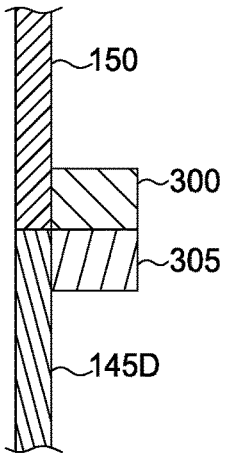
FIG. 4 is a sectional view of a portion of the bolt interface of FIG. 3.
Figure 3:
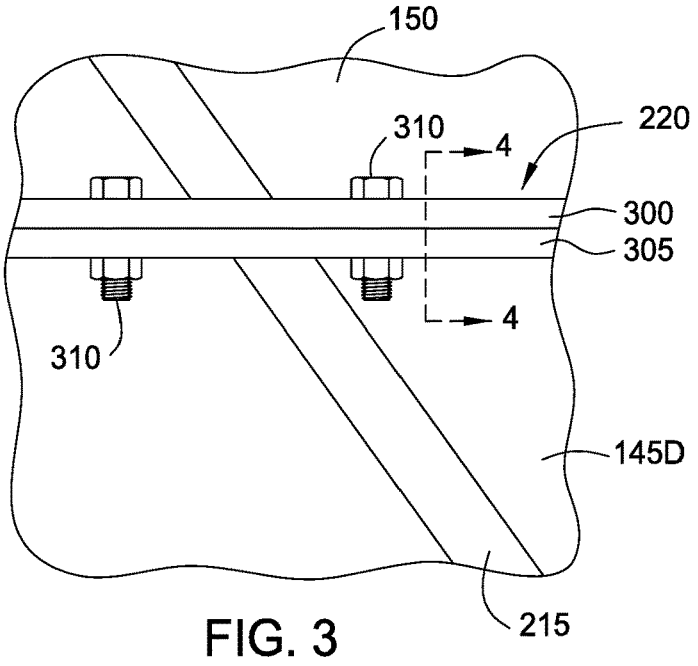
FIG. 3 is an enlarged side view of the bolt interface of FIG. 2.

FIG. 3 is an enlarged side view of the bolt interface 220 of FIG. 2. FIG. 4 is a sectional view of a portion of the bolt interface 220 of FIG. 3. Referring to FIGS. 3 and 4, the bolt interface 220 may include a first structural member 300 coupled to the flange portion 150, such as by welding or fasteners, and a second structural member 305 coupled to the flange segment 145D, such as by welding or fasteners. The first structural member 300 and the second structural member 305 may be flat bar, legs of angle iron, or other structural supporting shapes.

When the deconstructable spool 200 is intact, the first structural member 300 abuts the second structural member 305. Fasteners 310, such as nuts and bolts, may be utilized to fix the first structural member 300 to the second structural member 305, and thereby attach the flange segment 145D to the flange portion 145D. Likewise, the fasteners 310 may be removed to detach the flange segment 145D from the flange portion 150. The remaining flange segments 145A-145C may be attached and detached from the flange portion 150 in a similar manner such that the deconstructable spool 200 can be repeatedly constructed for reuse, and repeatedly deconstructed for ease of shipping.

FIGS. 5A-5C are schematic cutaway top views of an exemplary standard intermodal shipping container 400 showing various methods for shipping the deconstructable spool 100 or the deconstructable spool 200. A "standard intermodal shipping container" as described herein includes a container with an inside width of about 92 inches, and an outside length of between about 20 feet and about 53 feet with a maximum cargo capacity of between about 30,000 pounds and about 60,000 pounds, or greater. While the length and the height dimension may vary between containers, the inside width may be common with all containers.

The shipping container 400 includes a body 405 having major sides 410A adjacent to minor sides 410B, and at least one of the minor sides 410B includes a door for access to an internal volume 415. The internal volume 415 may include a length dimension 420 of between about 19.5 feet and about 52.5 feet, a width dimension 425 of about 7 feet, 8 inches (92 inches), and a height dimension (not shown) of between about 7 feet, 9 inches (93 inches) and about 9 feet, 1.5 inches (109.5 inches). The width dimension 425 and the height dimension are greater than the dimensions of the flange portion 150 (84 inches×88 inches, which relate to dimensions 165 and 135, respectively, of FIGS. 1A and 1B). The width dimension 425 and the height dimension are also greater than the dimensions of the flange segments 145A-145D (84 inches×5 inches×43 inches, which relate to dimensions 165, 130, and 155, respectively, of FIGS. 1A and 1B).

In the shipping method shown in FIG. 5A, the internal volume 415 may be divided into one, two, three, four, five, six, seven, or more large volumes, although five large volumes 430A-430E and four smaller volumes 435 in between the large volumes 430A-430E are shown. According to the length dimension 420, each of the large volumes 430A-430D may contain one core 110, with the flange portions 150, of the deconstructable spools 100 or 200. Each of the large volumes 430A-430E may include a length dimension 426 of about 88 inches while a length dimension 428 of each of the smaller volumes 435 may be about 12 inches.

The large volumes 430A-430E provide enough space to store the core 110, and the smaller volumes provide enough space to store the corresponding flange segments 145A-145D. Thus, the shipping container 400 according to the embodiment shown in FIG. 5A may provide shipping of four deconstructable spools 100 or 200 (i.e., four cores and thirty-two flange segments) with a large volume 430E having a length 440 of about 82 inches that is not occupied. The large volume 430E may also be utilized to ship cargo other than spools, or left empty. The weight of each of the deconstructable spools 100 or 200 within the internal volume 415 of the shipping container 400 according to the embodiment of FIG. 5A may be about 10,000 pounds that is multiplied by four to about 40,000 pounds, which is well within the capacity of the shipping container 400.

In the shipping method shown in FIG. 5B, the internal volume 415 may be divided into one, two, three, four, five, six, seven, or more large volumes, although five large volumes 430A-430E and a single smaller volume 435 is shown. The single smaller volume 435 may be at one end of the shipping container 400 as shown, or in between two of the large volumes 430A-430E. According to the length dimension 420, each of the large volumes 430A-430E may contain one core 110, including the flange portions 150, of the deconstructable spools 100 or 200 while the single smaller volume 435 may contain flange segments 145A-145D corresponding to the core 110 in the large volumes 430A-430E.

The single smaller volume 435 may include a length dimension 440 of about 32 inches which has space for 5 sets of flange segments 145A-145D that are stacked according to this embodiment. Thus, the shipping container 400 according to the embodiment shown in FIG. 5B may provide shipping of five deconstructable spools 100 or 200 (i.e., five cores and forty flange segments). The weight of the five deconstructable spools 100 or 200 within the internal volume 415 of the shipping container 400 according to the embodiment of FIG. 5B may be about 50,000 pounds, which is well within the capacity of the shipping container 400.

In the shipping method shown in FIG. 5C, the internal volume 415 may be divided into one, two, three, four, five, six, seven, or more large volumes, although five large volumes 430A-430E and a single smaller volume 435 similar to the embodiment shown in FIG. 5B is shown. According to the length dimension 420, each of the large volumes 430A-430E may contain one core 110, including the flange portions 150, of the deconstructable spools 100 or 200. However, the flange segments 145A-145D may be placed within the internal volume of the core 110 (i.e., inside the hollow tubular member) which leaves the single smaller volume 435 empty or free for shipment of other products. Thus, the shipping container 400 according to the embodiment shown in FIG. 5C may provide shipping of five deconstructable spools 100 or 200 (i.e., five cores and forty flange segments). The weight of the five deconstructable spools 100 or 200 within the internal volume 415 of the shipping container 400 according to the embodiment of FIG. 5C may be about 50,000 pounds, which is well within the capacity of the shipping container 400.

While the exemplary shipping container 400 is described having a length of about 40 feet, the shipping container 400 may have a shorter length, such as a length of about 20 feet, with a capacity to ship one of the deconstructable spools 100 or 200. Additionally, a shipping container with a length of about 45 feet, or a shipping container with a length of about 53 feet, may have the capacity to store and ship up to two, three, four, five, six, seven, or more of the deconstructable spools 100 or 200, respectively.

Figure 6A:
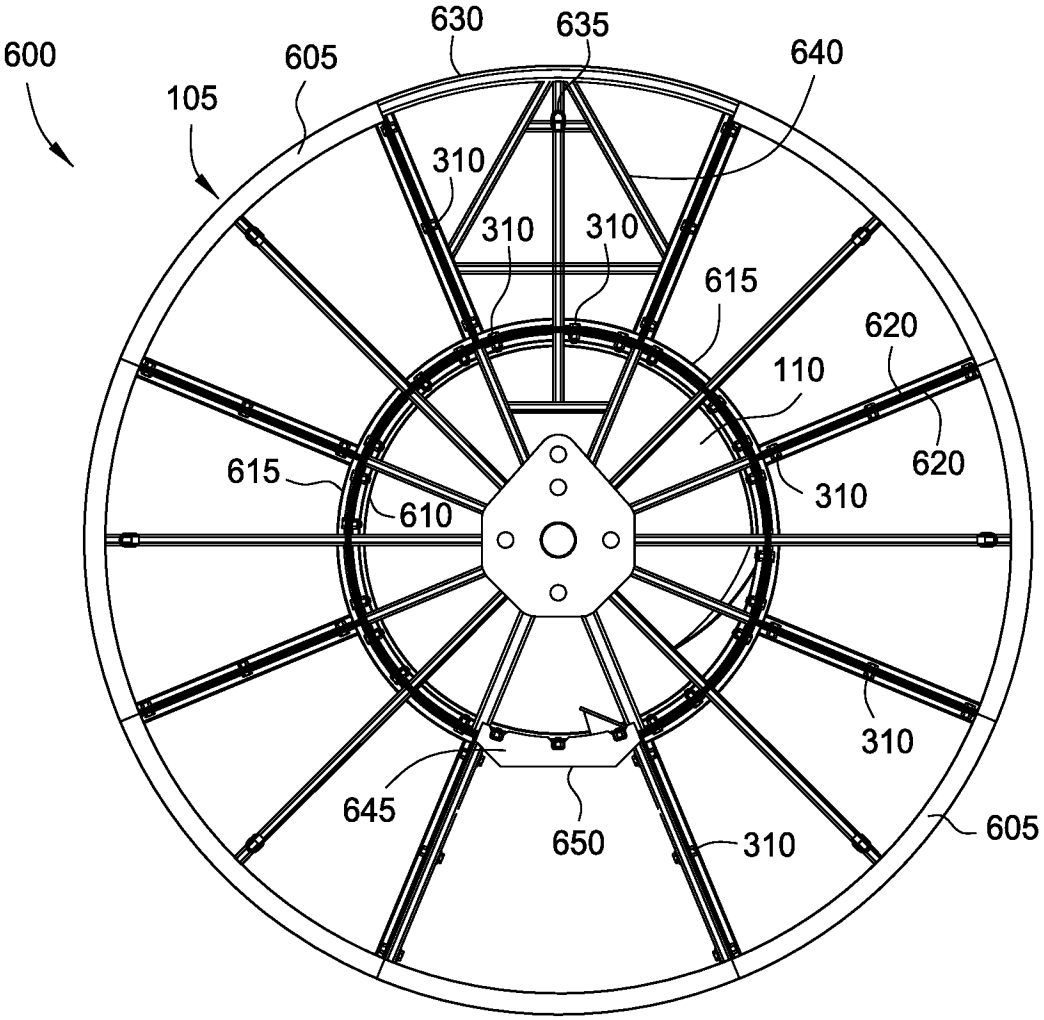
FIGS. 6A-6D illustrate a deconstructable spool according to one embodiment.
Figure 6B:
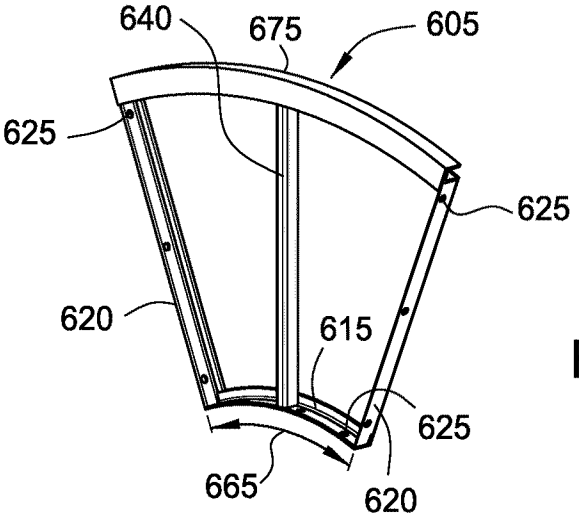
Figure 6C:
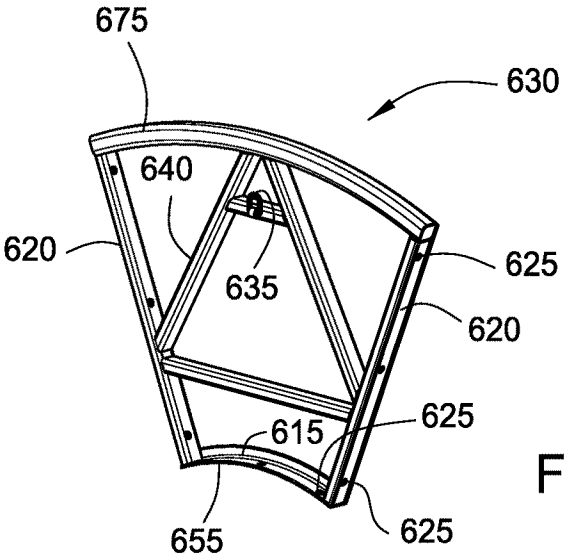
Figure 6D:
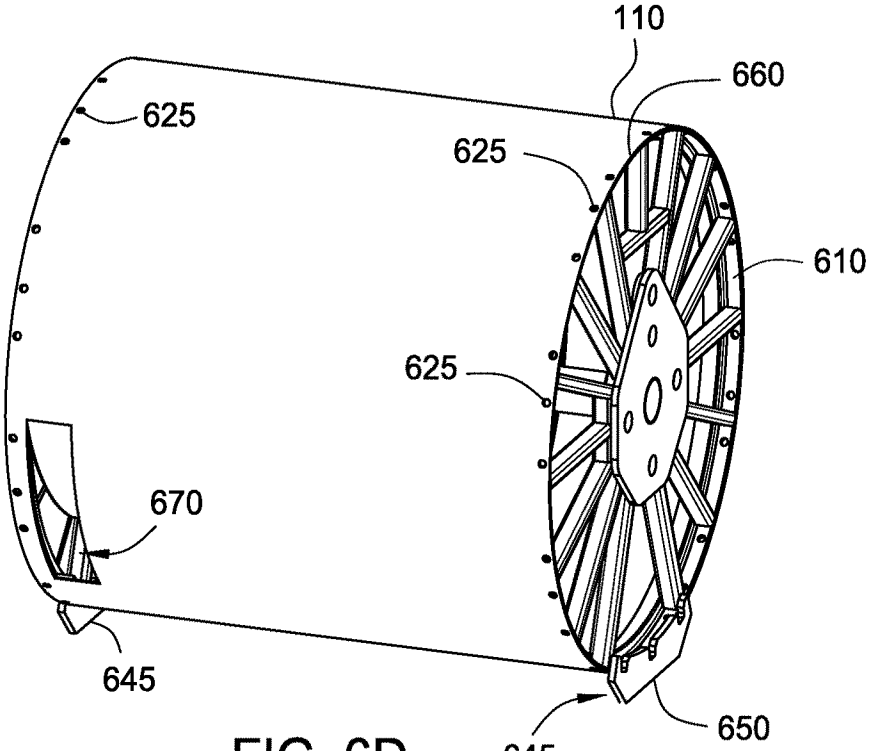

FIG. 6A is a side elevation view of a deconstructable spool 600 according to one embodiment. The front elevation view of the deconstructable spool may be similar to the deconstructable spool 100 as shown in FIG. 1B. FIG. 6B and FIG. 6C are isometric views of flange segments 605 of the deconstructable spool 600 shown in FIG. 6A. FIG. 6D is an isometric view of a core 110 of the deconstructable spool 600 of FIG. 6A.

Referring to FIGS. 6A-6D, the deconstructable spool 600 includes a plurality of flange segments 605 that are removably coupled to the core 110. Each flange segment 605 may be coupled to the core 110 by fasteners 310, which may be nuts and bolts as described above. The fasteners 310 may be disposed through openings 625 formed in the flange segments 605 that align with opening formed in the core 110. The openings 625 in the flange segments 605 are disposed through a first structural member 615 of the flange segments 605. The openings 625 in the core 100 are disposed through a plurality of structural members 610 that are attached to the ends of the core 110 and/or an outer surface 660 of the core 110 that is coupled to the structural members 610.

Similarly, the flange segments 605 may be coupled to each other to form the two flanges 105 of the deconstructable spool 600, only one of which is shown in FIG. 6A. In particular, the flange segments 605 include a pair of second structural members 620 coupled to the ends of the first structural member 615 to form the sides of the flange segments 605. The fasteners 310 may be disposed through openings 625 formed in the second structural members 620 to couple adjacent flange segments 605 together.

The flange segments 605 include a third structural member 675 coupled to the ends of the second structural members 620 opposite from the first structural member 615 to form the top of the flange segments 605. The flange segments 605 may further include one or more fourth structural members 640 coupled between and/or to the first, second, and/or third structural members 615, 620, 675 as shown in FIG. 6B and FIG. 6C. The first, second, third, and fourth structural members may be flat bar, rectangular tubing, angle iron, and/or other structural supporting members of different shapes.

The first structural member 615 of each the flange segment 605 includes an arcuate surface 655 that corresponds to the curvature of the outer surface 660 of the core 110. Each flange segment 605 includes an arc length 665 that is about 45 degrees. However, the arc length 665 is not limited to 45 degrees and may be 22.5 degrees, 90 degrees, and/or 120 degrees depending on the major dimension 120 as shown in FIG. 1B or other factors.

The flange segment 605 shown in FIG. 6C may be a load bearing flange segment 630. The deconstructable spool 600 may include one or more load bearing flange segments 630 although only one is shown in FIG. 6A and FIG. 6C. Each load bearing flange segment 630 may include at least three fourth structural members 640 coupled to each of the other structural members, as well as a lifting lug 635 coupled to the fourth structural members 640. The load bearing flange segments 630 may be used to suspend the deconstructable spool 600 by a crane when assembled.

The deconstructable spool 600 may include one or more support plates 645 coupled on each end of the core 110. Two support plates 645 are shown in FIG. 6D. The support plate 645 includes a flat portion 650 configured to stabilize and prevent the core 110 from rolling when the flange segments 605 are removed and the core 110 is placed on a flat surface. Also shown in FIG. 6D, is an opening 670 formed in the outer surface 660 of the core 110 where a tubing may be inserted to begin coiling of the tubing onto the core 110 of the deconstructable spool 600.

Embodiments of the deconstructable spools 100, 200, or 600 as described herein provide a coiled tubing spool that may be re-used. The deconstructable spools 100, 200, or 600 may be easily dismantled and shipped after use, and the spool may be re-constructed and re-spooled with another coiled tubing string.

While the foregoing is directed to embodiments of the disclosure, other and further embodiments of the disclosure may be devised without departing from the basic scope thereof, and the scope thereof is determined by the claims that follow.

The invention claimed is:

1. A deconstructable coiled tubing spool, comprising:

two or more flange segments, wherein an outer perimeter of at least two of the flange segments is defined by a convex shaped portion, two parallel flat shaped sides positioned on opposite ends of the convex shaped portion, and a flat shaped portion extending between the two parallel flat shaped sides; and a core comprising a flange portion that is adapted to couple and decouple from the flange segments, wherein an outer perimeter of the flange portion has a rectangular shape, wherein the core remains intact when the flange segments are decoupled from the flange portion, and wherein each flange segment has the same length dimension.

2. The spool of claim 1, wherein the core comprises a hollow tubular member, and wherein the flange portion of the core comprises rectangular plates coupled to opposite ends of the hollow tubular member.

3. The spool of claim 1, further comprising a bolt interface between the flange portion and each of the two or more flange segments.

4. The spool of claim 1, wherein the two or more flange segments comprises four flange segments.

5. The spool of claim 1, wherein the core has an opening into an interior volume of the core on one side.

6. The spool of claim 1, wherein the core and each of the two or more flange segments fit into a standard intermodal storage container.

7. The spool of claim 1, wherein the flange portion is welded to the core.

8. A standard intermodal shipping container, comprising:

an interior volume containing two or more deconstructable coiled tubing spools according to claim 1.

9. The shipping container of claim 8, wherein the flange segments are combined and stacked on one end of the interior volume.

10. The shipping container of claim 8, wherein the interior volume contains up to five deconstructable coiled tubing spools.

11. The shipping container of claim 8, wherein a portion of the interior volume is not occupied by the flange segments or the core.

* * * * *